US005715693A

United States Patent [19]

van der Walt et al.

[11] Patent Number: 5,715,693

[45] Date of Patent: Feb. 10, 1998

[54] REFRIGERATION CIRCUIT HAVING SERIES EVAPORATORS AND MODULATABLE COMPRESSOR

[75] Inventors: Nicholas R. van der Walt; Reuven Z. Unger, both of Athens, Ohio

[73] Assignee: Sunpower, Inc., Athens, Ohio

[21] Appl. No.: 690,226

[22] Filed: Jul. 19, 1996

[51] Int. Cl.[6] ..... F25B 41/00

[52] U.S. Cl. ..... 62/198; 62/227; 62/228.4; 62/228.5

[58] Field of Search ..... 62/198, 199, 228.4, 62/228.5, 227

[56] References Cited

U.S. PATENT DOCUMENTS

| | | | |
|---|---|---|---|
| 4,132,086 | 1/1979 | Kountz | 62/229 X |
| 4,439,998 | 4/1984 | Horvay et al. | 62/199 |
| 5,156,005 | 10/1992 | Redlich . | |
| 5,228,308 | 7/1993 | Day et al. . | |
| 5,251,455 | 10/1993 | Cur et al. | 62/199 |
| 5,465,591 | 11/1995 | Cur et al. . | |
| 5,477,915 | 12/1995 | Park | 62/198 X |
| 5,496,153 | 3/1996 | Redlich . | |

OTHER PUBLICATIONS

EPA Note to Correspondents, Jun. 3, 1993, pp. 2, 5, John Kasper, Director, Press Services Division.

U.S. Patent application, Serial No. 08/265,790, filed Mar. 21, 1994, Inventors: William T. Beale, Nicholas R. van der Walt, and Reuven Z. Unger.

*Primary Examiner*—Henry A. Bennett
*Assistant Examiner*—Susanne C. Tinker
*Attorney, Agent, or Firm*—Frank H. Foster; Kremblas, Foster, Millard & Pollick

[57] ABSTRACT

A refrigeration system having a modulatable compressor and a Rankine cycle refrigeration circuit having at least two evaporators. The flow rate of the compressor is modulated in response to the sensed temperature of the masses being cooled, and the control circuit switches valves to control the refrigerant flow path and modulates the flow rate of the compressor to optimize the efficiency of the refrigeration system.

8 Claims, 4 Drawing Sheets

| FREEZER COMPARTMENT | COMPARATOR OUTPUT | VALVE 16 | VALVE 18 | SUM |
|---|---|---|---|---|
| 0 | 0 | ON | OFF | NO |
| 1 | 1 | OFF | ON | YES |

REFRIGERATION CIRCUIT HAVING SERIES EVAPORATORS AND MODULATABLE COMPRESSOR

TECHNICAL FIELD

This invention relates generally to apparatus for pumping heat from one mass to another, such as is conventionally accomplished in heat pumps, refrigeration systems and air conditioning, and more particularly relates to a refrigeration circuit exhibiting improved efficiency as a result of having multiple evaporators and a linear compressor with a modulatable flow rate.

BACKGROUND ART

A conventional refrigerator/freezer appliance has two compartments, one for refrigerating fresh food and the other for freezing food. The two compartments are maintained at very different temperatures, typically −20° C. for the freezer compartment and +3° C. for the fresh food compartment. Heat is removed from these two compartments and rejected to the ambient environment. Such refrigeration apparatus most commonly utilizes the Rankine refrigeration cycle. More conventionally known in the United States as the vapor compression cycle.

The usual Rankine refrigeration circuit has a single evaporator in thermal contact with the air in the freezer compartment. Heat is removed from the fresh food compartment by circulating air between the fresh food compartment and the colder freezer compartment.

One disadvantage of this system is that all of the heat which is removed from either the fresh food compartment or the freezer compartment is removed at the considerably lower freezer temperature. Consequently even the heat from the fresh food compartment must be pumped through the higher thermal elevation from the freezer temperature to the ambient temperature. The efficiency and energy consumption of a refrigeration system can be substantially improved if the heat removed from the fresh food compartment can be removed directly from it at the fresh food temperature and elevated to the ambient temperature.

Refrigerators have also used two compressors, one for each of the two evaporators in order to achieve a higher efficiency by designing and operating each compressor at the maximum efficiency for the evaporator it supplies with refrigerant. However, this duplication of compressors increases cost and increases the volume occupied by the refrigeration equipment, consequently also reducing the refrigerated space.

Some refrigeration systems, such as that shown in U.S. Pat. No. 5,465,591, utilize a single compressor which alternatively directs the refrigerant to one evaporator or the other, but not simultaneously to both. Because the compressors used in the prior art operates at a single, constant pumping rate or displacement, such dual evaporator systems are inefficient because they have excessive capacity in the fresh food mode. Less work is required to pump heat from the higher temperature fresh food compartment because of the greater suction vapor density at the output of the fresh food evaporator.

Prior art workers have also connected evaporators in series so that one or more evaporators receive at least a portion of the refrigerant discharge from another evaporator. Such an arrangement is referred to in U.S. Pat. No. 5,228,308.

Consequently, refrigeration circuits have been constructed in the prior art in which one or multiple, conventional refrigerant compressors are connected with series or parallel connected evaporators.

Nonetheless, there remains a need to improve the efficiency of multiple compartment refrigeration systems in order to reduce the ever increasing cost of energy and improve environmental protection.

BRIEF DISCLOSURE OF INVENTION

The invention is a modulatable compressor in a Rankine cycle refrigeration circuit having at least two evaporators for cooling at least two masses. The refrigerant flow rate through the compressor is modulated in response to the sensed temperature of the two masses for providing cooling tailored to the cooling demand of the two masses and therefore minimizes the energy consumption of the refrigeration system.

In particular, the invention combines a free piston linear compressor with such a Rankine cycle refrigeration circuit, the linear compressor being driven by a linear, electromagnetic motor connected to a motor control circuit which is able to apply a variable drive voltage to the armature of the drive motor in order to modulate the refrigerant flow rate through the compressors in response to the cooling demands of the two refrigerated compartments in which the evaporators are located. Not only is the refrigerant flow rate modulated such as by varying the displacement of the free piston linear compressor, but preferably the two evaporators are connectable in series. As a consequence, refrigerant flow may be directed only along a flow path passing through the evaporator of the fresh food compartment or alternatively the refrigerant may be directed along a path passing first through the evaporator of the freezer compartment and then through the evaporator of the fresh food compartment. When only the fresh food evaporator is supplied with refrigerant, the refrigerant mass flow rate may be controlled to supply only the cooling demand of the fresh food compartment. When the evaporators are series connected, the refrigerant flow rate may be controlled so that either principally the freezer compartment is cooled, or, alternatively, so that both the freezer compartment and the fresh food compartment are cooled. Consequently, both the flow paths and the rate at which refrigerant is pumped by the compressor may be controllably varied to optimize the efficiency of a heat pumping apparatus embodying the present invention.

Figure 1:
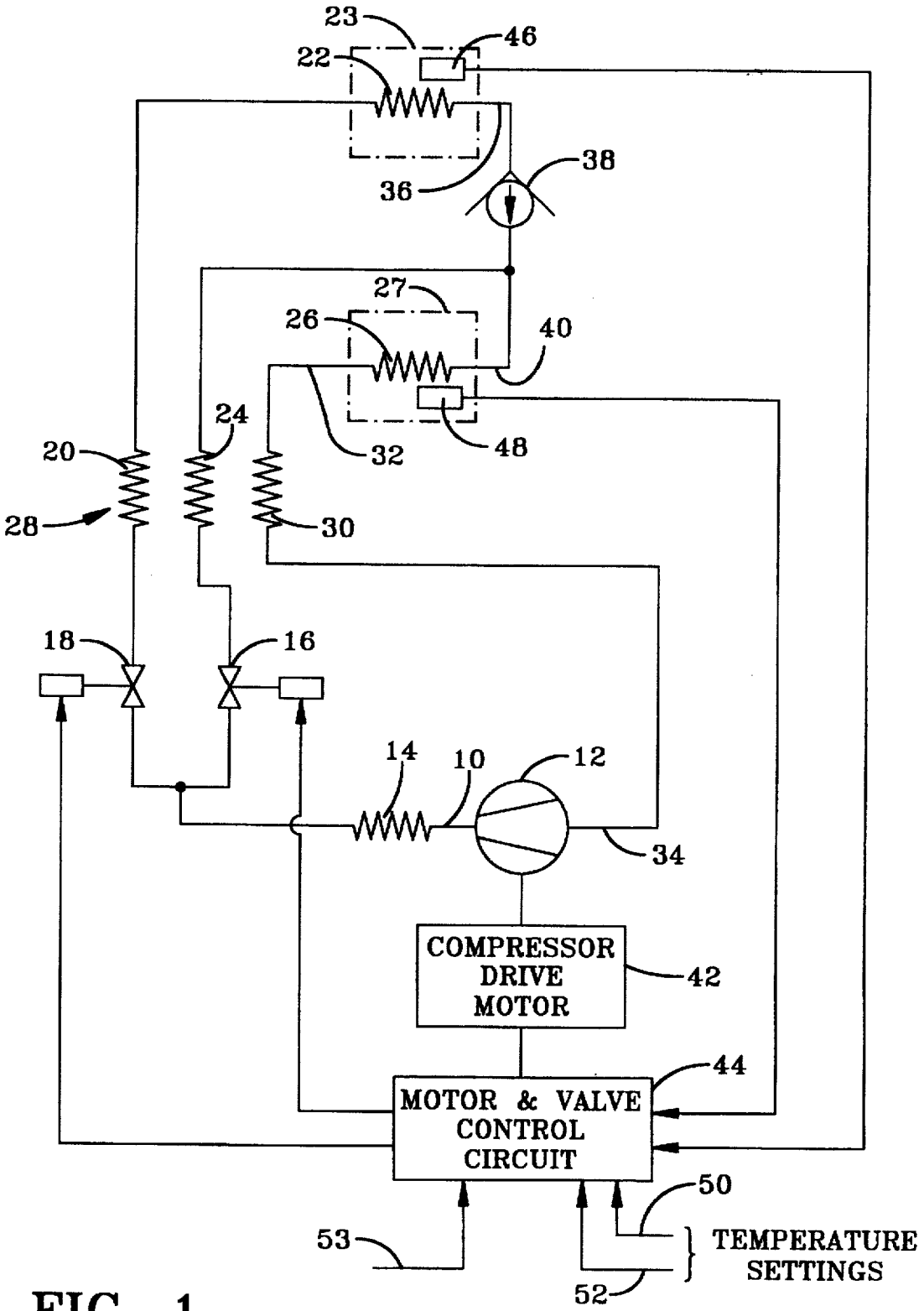
FIG. 1 is a schematic diagram illustrating the preferred embodiment of the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art. In addition, circuits are illustrated which are of a type which perform well known operations on electronic signals. Those skilled in the art will recognize that there are many, and in the future may be additional, alternative circuits which are recognized as equivalent because they provide the same operations on the signals. Further, those skilled in the art will recognize that, under well known principles of Boolean logic, logic levels and logic functions may be inverted to obtain identical or equivalent results.

DETAILED DESCRIPTION

FIG. 1 illustrates a schematic diagram of the preferred Rankine cycle refrigeration circuit of the invention. A Rankine cycle refrigeration circuit ordinarily includes an expansion orifice or capillary tube, an evaporator, connecting conduits, control valves, a condenser, a compressor and heat exchangers. FIG. 1 also includes a compressor drive motor and a motor and valve control circuit, shown as blocks and illustrated in more detail in FIGS. 2 and 3 and in a patent subsequently incorporated by reference. There is no mixing of air between the fresh food compartment and the freezer compartment.

The output 10 of a free piston linear compressor 12 is connected in the conventional manner to a condensor 14. The output of the condensor 14 is connected to the inputs of two actuable valves, preferably a fresh food solenoid valve 16 and a freezer solenoid valve 18. The output of the solenoid valve 18 is directed through a capillary tube 20 to the input of a freezer evaporator 22 which is in thermal connection to the lower temperature freezer compartment 23. The solenoid valve 16 is connected through a capillary tube 24 to the input of a fresh food evaporator 26 which is in thermal connection to the relatively higher temperature fresh food compartment 27. Each of the two compartments 23 and 27 contain a mass which must be cooled, the mass including the contained air and food contents. The capillary tubes 20 and 24 are thermally connected to each other in a heat exchanger 28, which also includes a third heat exchanger conduit 30. Expansion valves may be substituted for capillary tubes, as is well known in the art. The heat exchanger conduit 30 is interposed in a connection between the output 32 from the fresh food evaporator 26 to the suction input 34 of the compressor 12 to form the suction line path.

The output 36 of the evaporator 22 is connected through a check valve 38 to the input 40 of the fresh food evaporator 26. The check valve is oriented to permit refrigerant flow from the freezer evaporator 22 to the fresh food evaporator 26.

The free piston linear compressor 12 is driven by a compressor drive motor 42. The compressor 12 and its drive motor 42 are described below in connection with FIG. 2. The compressor drive motor 42, as well as the solenoid valves 16 and 18 are controlled by a motor and valve control circuit 44. The control circuit 44 output values are determined by inputs from a freezer temperature sensor 46, positioned in the freezer compartment 23, a temperature sensor 48, positioned in the fresh food compartment 27, and the input temperature settings 50 and 52, one for each compartment. The input temperature settings may be manually input to the control circuit 44 by any of many conventional input devices, such as key pads or potentiometers. Of course, continuous electrical power is applied at a power input 53 and controllably applied by the control circuit 44 to the motor 42.

In operation, the compressed refrigerant from the compressor 12 may be directed along either of two fluid flow paths, as determined by the state of the solenoid valves 16 and 18. In one mode the solenoid valve 18 is closed and the solenoid valve 16 is opened so that refrigerant is directed through the capillary tube 24, which is sized to cause evaporation at a temperature sufficiently below the fresh food temperature to remove heat from the fresh food compartment 27. The refrigerant evaporates in the fresh food evaporator 26 and is returned to the compressor via the suction line heat exchanger 28 into the suction input 34 of the compressor 12. The one-way check valve 38 prevents refrigerant from accumulating in the freezer evaporator 22 during this fresh food only mode.

In the second mode the solenoid valve 16 is closed and the solenoid valve 18 is opened. In this mode, the condensed refrigerant flows simultaneously through both evaporators. The refrigerant is directed through the capillary tube 20, which is sized to cause evaporation at a temperature sufficiently below the freezer temperature to remove heat from the freezer compartment 23. The refrigerant evaporates in the freezer evaporator thereby removing heat and then flows in series through the one-way valve and through the fresh food evaporator 26, removing some heat from the fresh food compartment and becoming superheated to the fresh food temperature. The refrigerant flowing in this series path is then returned to the compressor through the return path into the suction input 34 of the compressor 12.

The flow rate of the mass of refrigerant pumped through a compressor is a function of the pump displacement, refrigerant density, and compressor frequency, that is the number of pumping cycles per unit of time. The mass flow rate of refrigerant is the critical parameter because it is the mass of refrigerant delivered to and evaporated in an evaporator which determines the amount of heat absorbed by the refrigerant. The mass flow rate of refrigerant is typically modulated by modulating the displacement or the frequency or both of the compressor. It should be borne in mind, however, that, since mass flow rate is a function of refrigerant density, pump displacement does not alone determine mass flow rate. Consequently, a given or selected displacement will provide a different mass flow rate for refrigerants of different densities. Since refrigerant vapor pressure increases exponentially as a function of temperature, refrigerant exiting the fresh food evaporator is substantially more dense than refrigerant exiting the freezer evaporator. Therefore, although mass flow rate may be modulated by varying displacement, the design engineer should bear in mind that mass flow rate and volume flow rate, (i.e. displacement) are not identical. Therefore, the refrigerant mass flow rate is a function of multiple variables within the refrigerant system and is not a fixed characteristic of the compressor itself. Characteristics of the compressor would include its compression ratio and displacement.

Because the flow rate through the compressor 12 may be modulated and therefore controllably varied by the control circuit 44, the flow rate and therefore the cooling rate for both flow paths may be varied in response to cooling demand. As a part of this, in the series flow path mode through both evaporators, the flow rate may be at a flow rate which is sufficiently low that only refrigerant vapor passes from the freezer evaporator 22 into the fresh food evaporator 26, or alternatively at a higher flow rate so that liquid refrigerant enters the input 40 of the fresh food evaporator 26 to also provide substantial, additional cooling of the fresh food compartment 27.

Figures 4, 5:
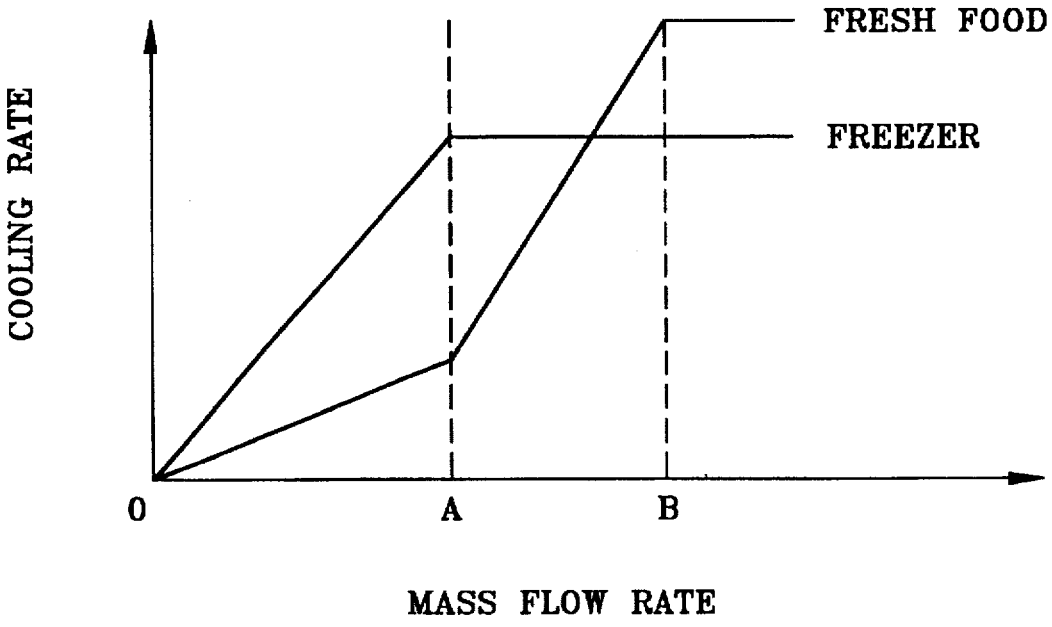
FIG. 4 is a truth table illustrating the operation of the control circuit of FIG. 3.
FIG. 5 is a graph illustrating the relationship of refrigerant flow rate to the cooling rate in the operation of embodiments of the invention in the series mode.

This operation is illustrated in the graph of FIG. 5. At refrigerant flow rates below flow rate A, the freezer is cooled by evaporation of liquid refrigerant and the fresh food compartment is cooled by heating the vapor from the freezer temperature to the fresh food temperature, i.e. by superheating. Vaporization of refrigerant is completed within the freezer evaporator and only vapor is passed on to the fresh food evaporator.

For flow rates above flow rate A, vaporization of all the refrigerant is not completed in the freezer evaporator. Some of the refrigerant exiting the freezer is liquid and evaporates in the fresh food evaporator. Thus, cooling in the fresh food compartment is the result of both evaporation and superheating. Cooling in the freezer evaporator does not increase further with an increase in flow rate because the freezer evaporator is saturated. However, above flow rate A, cooling in the fresh food compartment increases rapidly with flow rate due to the combined effect of increased refrigerant evaporation and superheating.

At flow rate B the fresh food evaporator also is saturated with liquid refrigerant. Further increases in flow rate do not increase evaporation but merely increase liquid flow rate out of the fresh food evaporator without increasing cooling. The cooling effect of such liquid is wasted in cooling the suction line and/or the compressor.

Thus, when the evaporators are series connected, the cooling in the fresh food compartment is substantially controlled at flow rates between flow rate A and flow rate B and in this range the freezer cooling is at a maximum. This mode is inefficient for flow rates above flow rate A because all the cooling by evaporation which occurs in the fresh food compartment takes place at the freezer temperature. Cooling in this mode at flow rates between A and B is appropriate when maximum cooling is needed in the freezer simultaneously with a demand for a major cooling of the fresh food compartment. When a relatively minor holding cooling demand is required in the fresh food compartment, the flow rate may be below flow rate A. However, when there is no demand for cooling of the freezer compartment but a major demand for cooling of the fresh food compartment, refrigerant may be directed only through the fresh food evaporator.

A linear compressor is particularly suitable for use in the above refrigeration circuit because its swept volume (i.e. displacement) can be easily, controllably modulated during operation. This allows the mass flow rate of refrigerant to be adjusted to match the needs of the active mode. When switching from the series connected freezer mode to the fresh food only mode, the swept volume of the compressor needs to be reduced since the density of the suction vapor is much higher and would otherwise lead to an excessive mass flow rate, which would in turn overload the heat exchangers and reduce the cycle efficiency. As will be described below, the control system adjusts the flow rate through the compressor and switches between the freezer and fresh food only modes to maintain the desired temperatures in the two compartments. When there is no demand for cooling from either compartment, solenoid valve 16 is open and solenoid valve 18 is closed.

While the Rankine cycle refrigeration circuit has been described in terms of a typical domestic refrigerator/freezer, the principles of the invention are also applicable to other Rankine cycle refrigeration circuits in which multiple masses are commonly cooled. Thus, for example, these principles could be utilized in an air conditioning system for cooling two or more different locations to different temperatures or a combination air conditioning and walk-in cooler refrigeration system, as well as other Rankine cycle refrigeration systems having multiple evaporators.

A linear compressor is a positive displacement, piston-type compressor in which the piston is driven directly by a linear motor, rather than by a rotary motor coupled to a mechanical mechanism as in a conventional reciprocating compressor. The reciprocating mass of piston and motor must be resonated or near resonated with a combination of mechanical and gas springs to avoid very high reactive motor currents which would otherwise be needed and which would affect motor efficiency and size. In a linear compressor, the piston motion is not defined by the geometry of the driver mechanism as in a conventional reciprocating compressor. Both the amplitude and mid position of the piston motion can change and these are dictated by the mechanical, electromagnetic and pressure forces acting on the piston. This can be a disadvantage since the piston motion is not pre-defined, making it necessary to have some mechanism to control piston position or to allow generous mechanical clearances, particularly when fragile parts might collide. However, the linear compressor is more versatile, since the piston motion can be adjusted continually to achieve optimum performance.

For high pressure ratio applications such as freezers, a mechanism to control the top dead center (TDC) position of the piston is required to minimize dead volume. This is achieved by adjusting the RMS voltage to the compressor with a simple wave-chopping triac based circuit which uses the TDC position of the piston in a feedback loop. Such a circuit is illustrated in U.S. Pat. No. 5,156,005 to Redlich and is incorporated by reference. Two types of sensing elements for piston position have been used. The first is the motor itself, which can be used to detect piston position. The second is a simple inductive pickup. Both have demonstrated satisfactory performance. These controls offer intrinsic capacity modulation since the means to vary the piston amplitude are already built into the controller/driver.

Linear compressors have three unique, efficiency related features. The first is that, because all the driving forces act along the line of motion, there is no sideways thrust on the piston, substantially reducing bearing loads and allowing the use of gas bearings or low viscosity oil. This results in extremely low friction losses compared to other compressor types. The second is that permanent magnet motors with above 90% efficiency can easily be achieved. Finally, capacity modulation can easily be achieved as described above.

The compressor driver motor used with linear compressors intrinsically provides capacity modulation capability. By changing the top dead center position of the piston the capacity can be controlled. Using this mechanism to modulate capacity raises the issue of gas hysteresis losses. However, one must remember that as the capacity is reduced the load and hence temperature drops in the heat exchangers are also reduced. This results in a reduction in compression ratio with capacity which offsets the increased dead volume resulting in no significant change in the gas hysteresis loss in the compressor. Flow and leakage losses will also be reduced.

Figure 2:
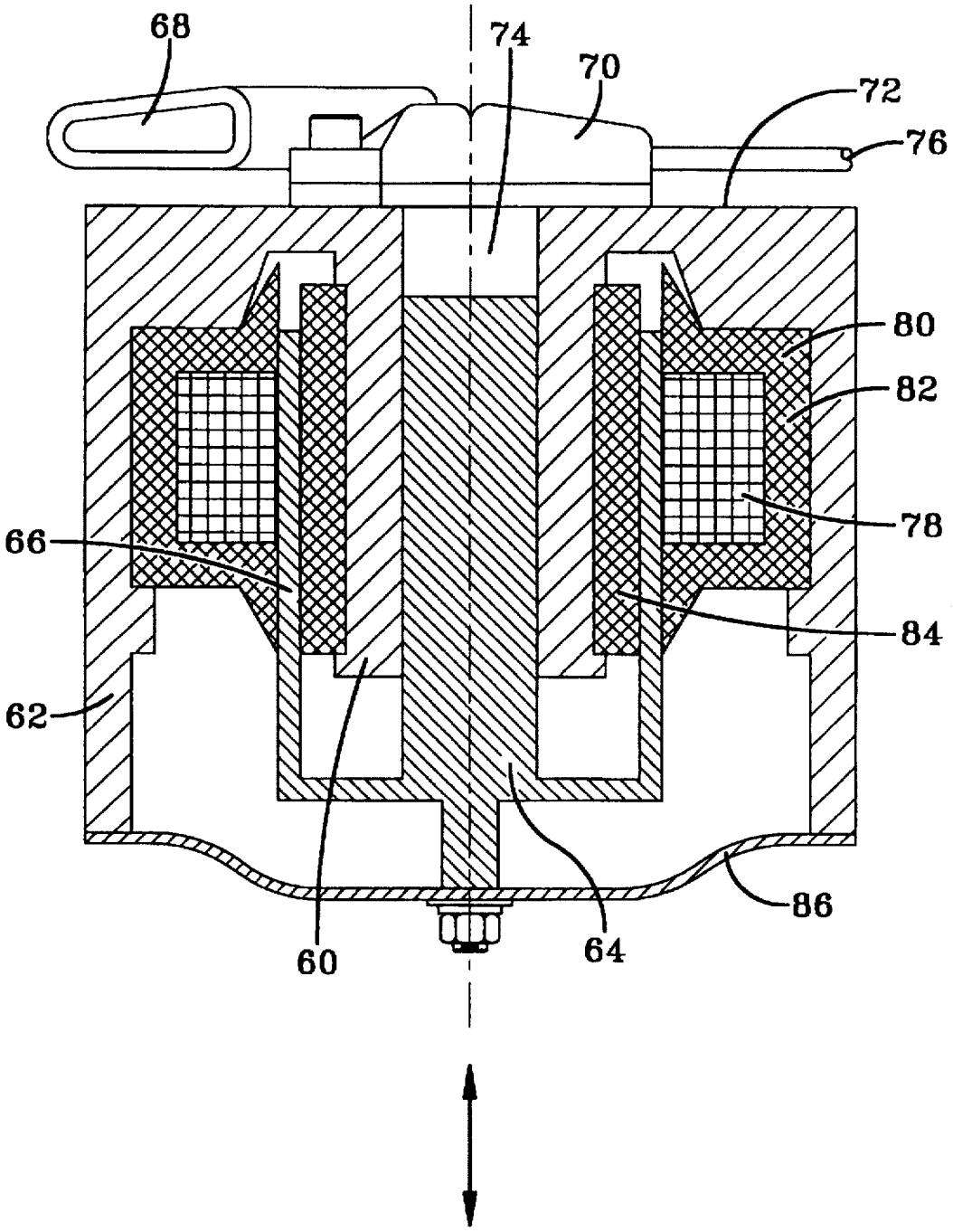
FIG. 2 is a schematic diagram of a linear compressor.

Although modulatable flow rate, linear compressors may have been shown in the prior art, FIG. 2 illustrates such a compressor. FIG. 2 illustrates a unit which includes both a free piston linear compressor as well as its integrally formed drive motor. The linear compressor includes its input and exhaust valves, which are usually one-way check valves commonly used in compressors, together with a cylinder, piston and connecting rod. A linear motor includes an armature winding to which an alternating voltage is applied, as well as magnets which are connected to the piston and driven in oscillating reciprocation by the time changing current in the armature and its resultant time changing magnetic field. The entire unit is designed with masses and spring constants so that they are resonant at or near the frequency of the applied voltage in order to maximize efficiency of operation.

The free piston linear compressor and motor of FIG. 2 has a cylinder 60 which extends outwardly to also form a supporting housing 62. A piston 64 is slidably mounted for reciprocation within the cylinder 60 and is connected to a surrounding magnetic ring 66. A suction muffler 68 and a valve assembly 70 containing the conventional inlet and exhaust valves is mounted at the head end 72 of the cylinder 60. Refrigerant is drawn from the suction muffler 68 into the compression space 74 and compressed and exhausted for discharge from the discharge line 76. A surrounding coil forms an armature 78 positioned within a conventional laminated surrounding low reluctance magnetic path 80 which includes the outer laminations 82 and inner laminations 84. The piston is supported by a planar spring 86 which has a spring constant resonating the mass of the piston 64 and its attached structures at the operating frequency of the controlled AC power input applied to the armature 78. The voltage of the electrical power applied to the armature 78 is varied by the motor and valve control circuit 44, illustrated in FIG. 1. Increasing the voltage increases the piston stroke, while decreasing the voltage decreases the piston stroke, and therefore has a corresponding effect upon the compression flow rate.

The flow rate through the compressor can also be controlled by a "pneumatic" control technique in which the motor is continuously operated at a constant given stroke, but the mean position of the piston is varied to change the effective compression ratio and thereby vary the flow rate. This may be accomplished using the end position limiting concepts and apparatus described in copending U.S. patent application Ser. No. 08/265,790 for which the issue fee has been paid and which is hereby incorporated by reference. FIG. 9 of that patent application illustrates a linear motor compressor unit very similar to that in FIG. 2 of this application. The end position limit is adjustable by providing an axially slidable port, for example, in the cylinder wall. The position of the port determines the end position and consequently axial translation of the port position will axially translate the mean piston position and consequently will vary the compression ratio of the compressor.

The mean position may also be varied by detecting the top dead center position (TDC) of the compressor piston, as shown in U.S. Pat. No. 5,496,153 which is incorporated herein by reference and controllably varied to modulate the compression ratio and therefore the flow rate.

Figure 3:
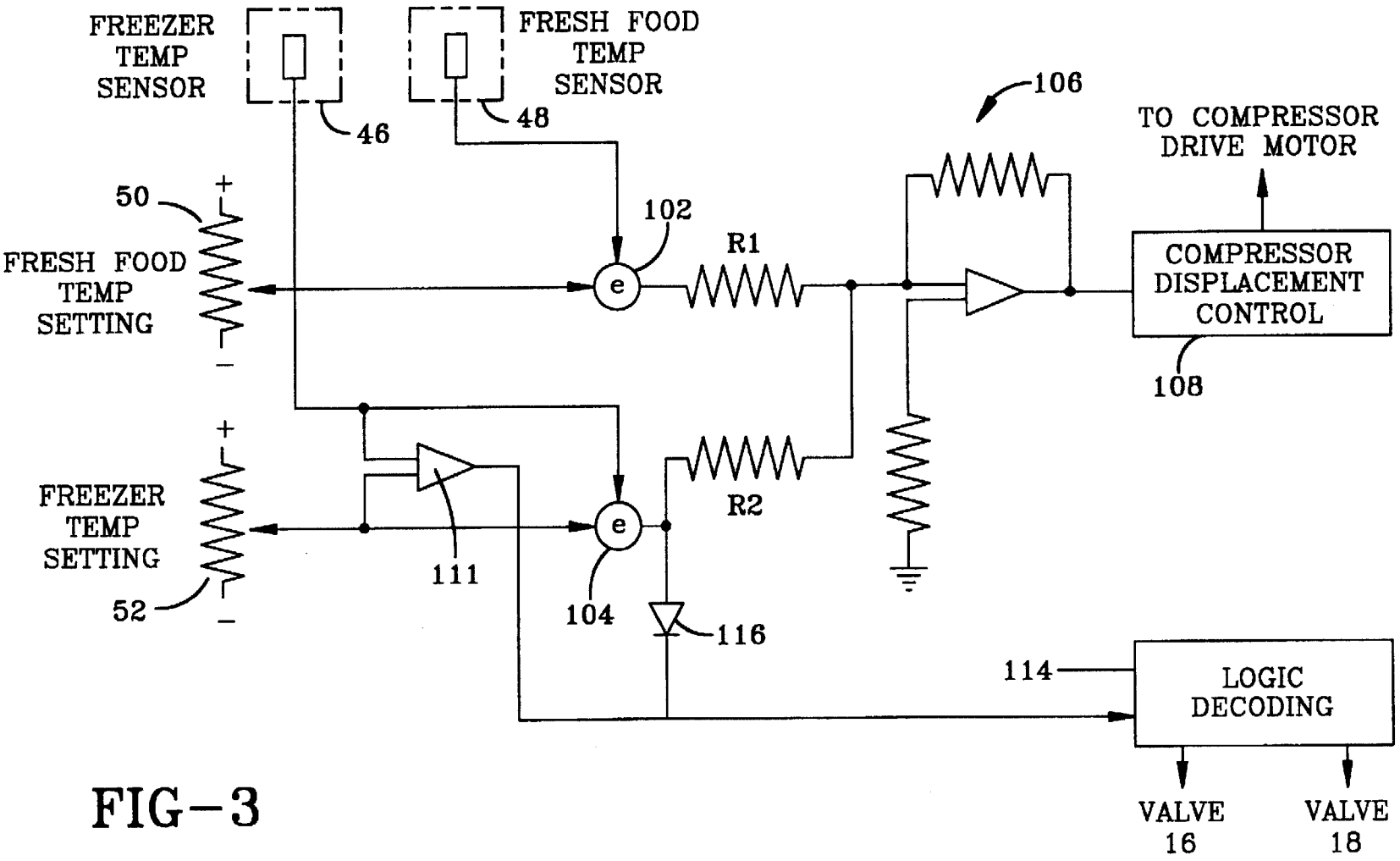
FIG. 3 is a schematic diagram of a control circuit for controlling the pumping rate of the free piston linear compressor and the refrigerator circuit valves of the preferred embodiment of the invention.

FIG. 3 illustrates a control circuit for use in embodiments of the present invention. It utilizes conventional feedback control principles in which a temperature set point signal is algebraically subtracted from a sensed temperature signal to provide an error signal which is amplified and controls the compressor displacement. Referring to FIG. 3, the fresh food temperature setting input 50 and the freezer temperature setting input 52 are each connected to summing junctions 102 and 104, as are the temperature inputs from the freezer temperature sensor 46 and the fresh food temperature sensor 48. The error signal representing the difference between the fresh food temperature setting at input 50 and the fresh food temperature sensed at temperature sensor 48 is applied through one resistor R1 of an adder circuit to the input of an amplifier circuit 106. The difference between the freezer temperature set point at input 52 and the sensed freezer temperature from freezer temperature sensor 46 is applied through the second adder circuit resistor R2 to the amplifier 106. The output from the amplifier 106 therefore has a magnitude which is proportional to the desired pump flow rate. That output from the amplifier 106 is applied to a compressor displacement control, such as that illustrated in the above-cited Redlich Patent U.S. Pat. No. 5,156,005 which controls the amplitude of the drive motor and therefore the flow rate through the compressor.

A logic circuit is used to control the solenoid valves 16 and 18, illustrated in FIG. 1. A comparator 111 is connected to the signal from the freezer temperature sensor 46 and to the signal from the freezer temperature setting input 52 to provide a logical one output when the sensed temperature exceeds the setting and consequently there is a freezer cooling demand and a logical zero output when it does not. The output of the comparator 111 is connected to a logic decoding circuit 114 which converts the logical zero and logical one output from the comparator 111 to voltages applied to the solenoid valves 16 and 18 for turning them on and off in accordance with the circuit logic. A diode 116 is connected between the input to the resistor R2 and the output of the comparator 111 for clamping the output of the summing junction 104 when the output of the comparator 111 is at a logical zero.

FIG. 4 shows a truth table illustrating the operation of the circuit of FIG. 3. Referring to that truth table, a "0" under the heading "Freezer Compartment" designates the absence of a cooling demand from the compartment, which occurs when the sensed temperature for the compartment is less than or equal to the set point temperature. A "1" indicates the presence of a cooling demand because the temperature of the compartment exceeds the set point temperature.

If the freezer compartment exhibits no demand, the comparator 111 provides a logical zero output and the logic decoding circuit 114 turns on valve 16 and turns off valve 18. With the logical zero output from the comparator 111 the diode 116 clamps the resistor R2 to logic zero level so that only the error signal for the fresh food compartment controls the mass flow rate through the compressor by means of the feedback control circuit.

If the freezer compartment exhibits a cooling demand, the comparator 111 output is a logical 1 and the logic decoding circuit 114 turns valve 16 off and valve 18 on. The logical one output of the comparator 111 unclamps the input R2 so that the error signal for the freezer portion of the feedback control system may be summed with the fresh food error signal to drive the compressor at an increased flow rate corresponding to the sum of the cooling demand of the two compartments.

It would be apparent to those skilled in the art that alternatively a control circuit may be utilized which simply has a selected, predetermined pump displacement associated with each of the two operating states illustrated in FIG. 4. More sophisticated control can be achieved using a computer and software to provide desired output flow rates according to known control algorithms in response to the variety of temperature differences between the set temperature for each compartment and the sensed temperature for each compartment.

Additional temperature sensors may detect additional temperatures, such as, for example, an emergency temperature level. This would provide two additional inputs to the logic decoding circuit 114, thus providing 16 possible combinations and operating conditions for the refrigeration system.

It should now be apparent to those skilled in the art that other types of prime movers or motors may be used to drive a linear compressor in a manner which permits modulation of the mass flow rate through the compressor. These include a Stirling engine, steam engine or a linear internal combustion engine or even a rotating motor with an adjustable linkage, although none of these are believed nearly as advantageous as the embodiments disclosed.

Additionally, the mass flow rate of the refrigerant may be modulated with compressors other than linear compressors, even though linear compressors are believed most suitable. For example, an electronically commutated motor, sometimes referred to as a brushless dc motor, can be linked to drive a conventional crank-type compressor. Such a motor has a variable speed allowing the refrigerant flow rate to be modulated by controlling the motor rotation speed.

As a result, it can be seen that the present invention tailors the refrigerant mass flow rate through the compressor and the flow paths through the refrigeration circuit to precisely meet the cooling demands of both of the compartments.

While certain preferred embodiments of the present invention have been disclosed in detail, it is to be understood that various modifications may be adopted without departing from the spirit of the invention or scope of the following claims.

We claim:

1. A heat pumping apparatus for lifting heat from lower temperature masses to a higher temperature mass, the apparatus comprising:

(a) a vapor compression cycle refrigeration circuit including a refrigerant contained in the circuit and at least two evaporators in thermal connection to the lower temperature masses wherein at least two evaporators are series connected through conduits in the refrigerant circuit to provide a series refrigerant flow path simultaneously extending through a first one of the evaporators for maintaining a first temperature and a second one of the evaporators for maintaining a second temperature which is higher than the first temperature wherein the first evaporator is in thermal connection to a freezer compartment of a refrigeration appliance and has an input connected to an output of a condenser and through the condenser to the compressor output and the second evaporator is in thermal connection to a fresh food compartment of the refrigeration appliance and has an input connected through an actuable valve to the output of the condenser and through a check valve to an output of the freezer evaporator, the check valve being oriented to permit refrigerant flow from the freezer evaporator to the fresh food evaporator, the fresh food evaporator having an output connected to the input of the compressor;

(b) a linear compressor having an input and an output in fluid communication in the refrigeration circuit for compressing refrigerant;

(c) a linear electromagnetic motor having an armature winding and drivingly linked to the compressor; and (d) a motor control circuit having an electrical power input, an electrical power output connected to the armature winding and applying a variable drive voltage to the armature winding for modulating the refrigerant flow rate of the compressor.

2. A heat pumping apparatus for lifting heat from at least two lower temperature masses, one of which is lower than the other, to a higher temperature mass, the apparatus including a vapor compression cycle refrigeration circuit including a refrigerant contained in the circuit, the apparatus comprising:

(a) a compressor/drive motor combination having a modulatable flow rate and having a refrigerant input and a refrigerant output in fluid communication in the refrigeration circuit;

(b) at least two evaporators, a first one of the evaporators in thermal connection to a first, lowest temperature mass and the second of the evaporators in thermal connection to a second, lower temperature mass having a temperature interposed between the temperature of the lowest temperature mass and the higher temperature mass, the first evaporator having an input connectible through a valve to receive refrigerant compressed by the compressor and an output connected to an input of the second evaporator, the second evaporator having an input connectible through a valve to receive refrigerant compressed by the compressor and an output connected to return refrigerant to the compressor for at times directing the refrigerant in series through both the first and the second evaporators and at times directing the refrigerant through only the second evaporator and blocking refrigerant flow through the first evaporator; and (c) a control circuit including sensors for sensing the temperature of the masses and connected to the compressor/drive motor combination for modulating the flow rate in response to the sensed temperatures.

3. An apparatus in accordance with claim 2 wherein the compressor is a free piston linear compressor and the motor is a linear electromagnetic motor having an armature winding and wherein the control circuit is a motor control circuit having an electrical power input, an electrical power output connected to the armature winding and applying a variable drive voltage to the armature winding for modulating the refrigerant flow rate of the compressor.

4. An apparatus in accordance with claim 3 wherein the control circuit includes a feedback control system modulating the refrigerant flow rate in proportion to the sum of the difference between a sensed temperature of the first mass and a selected set point temperature for the first mass and the difference between a sensed temperature of the second mass and a selected set point temperature of the second mass.

5. An apparatus in accordance with claim 2 wherein the control circuit includes a feedback control system modulating the refrigerant flow rate in proportion to the sum of the difference between a sensed temperature of the first mass and a selected set point temperature for the first mass and the difference between a sensed temperature of the second mass and a selected set point temperature of the second mass.

6. A heat pumping apparatus for lifting heat from a fresh food compartment and a freezer compartment to a higher temperature mass, the apparatus including a vapor compression cycle refrigeration circuit including a refrigerant contained in the circuit, the apparatus comprising:

(a) a linear compressor having an input and an output in fluid communication in the refrigeration circuit for compressing refrigerant;

(b) a linear electromagnetic motor having an armature winding and drivingly linked to the compressor;

(c) at least two evaporators including a freezer evaporator in thermal connection to the freezer compartment and a fresh food evaporator in thermal connection to the fresh food compartment, the freezer evaporator having an input connectible through a valve to receive refrigerant compressed by the compressor and an output connected to an input of the second evaporator, the fresh food evaporator having an input connectible through a valve to receive refrigerant compressed by the compressor and an output connected to return refrigerant to the compressor for at times directing the refrigerant in series through both the freezer and the fresh food evaporators and at times directing the refrigerant through only the fresh food evaporator and blocking refrigerant flow through the freezer evaporator; and (d) a motor control circuit having an electrical power input, an electrical power output connected to the armature winding and applying a variable drive voltage to the armature winding for modulating the refrigerant flow rate of the compressor.

7. An apparatus in accordance with claim 6 wherein:

(a) the freezer evaporator has an input connected to an output of a condenser and through the condenser to the compressor output; and (b) the fresh food evaporator has an input connected through an actuable valve to the output of the condenser and through a check valve to an output of the freezer evaporator, the check valve being oriented to permit refrigerant flow from the freezer evaporator to the fresh food evaporator, the fresh food evaporator having an output connected to the input of the compressor.

8. An apparatus in accordance with claim 6 wherein the control circuit includes a temperature sensor for sensing the temperature of the fresh food compartment, a temperature sensor for sensing the temperature of the freezer compartment and a feedback control system modulating the refrigerant flow rate in proportion to the sum of the difference between a sensed temperature of the freezer compartment and a selected set point temperature for the freezer compartment and the difference between a sensed temperature of the fresh food compartment and a selected set point temperature for the fresh food compartment.

* * * * *